US005322241A

United States Patent [19]

Carlson et al.

[11] Patent Number: 5,322,241

[45] Date of Patent: Jun. 21, 1994

[54] CONSOLIDATED OPTICAL SIGHT AND INFRARED TRACKER FOR A PORTABLE MISSILE LAUNCHER

[75] Inventors: James J. Carlson, Woodland Hills; Dzung V. Phan, Moorpark, both of Calif.

[73] Assignee: Hughes Aircraft Company, Los Angeles, Calif.

[21] Appl. No.: 993,748

[22] Filed: Dec. 14, 1992

[51] Int. Cl.[5] ..... F41G 7/00

[52] U.S. Cl. ..... 244/3.11

[58] Field of Search ..... 244/3.1, 3.11, 3.13, 244/3.14; 250/353

[56] References Cited

U.S. PATENT DOCUMENTS

| | | | |
|---|---|---|---|
| 3,761,714 | 9/1973 | Fernandez et al. | 250/348 |
| 3,974,383 | 8/1976 | Chapman | 244/3.11 |
| 4,183,482 | 1/1980 | Jozwiak | 244/3.11 |
| 5,042,742 | 8/1991 | Hufault et al. | 244/3.11 |

*Primary Examiner*—Ian J. Lobo

*Attorney, Agent, or Firm*—Charles D. Brown; Randall M. Heald; Wanda K. Denson-Low

[57] ABSTRACT

The eyepiece (14), objective lens assembly (24), long wavelength infrared sensor (27), missile guidance electronics (30), and all component parts are arranged in a consolidated package for mounting onto a portable missile launcher (10).

3 Claims, 2 Drawing Sheets

CONSOLIDATED OPTICAL SIGHT AND INFRARED TRACKER FOR A PORTABLE MISSILE LAUNCHER

BACKGROUND

1. Field of the Invention

The present invention relates to a consolidated optical sight and infrared missile tracker system, and, more particularly, to such a system for use on a portable missile launcher.

2. Description of Related Art

One form of missile with which we are particularly concerned here, on being launched to intercept a designated target includes an infrared beacon that is monitored by infrared tracking apparatus at the launch site to determine the real-time course of the missile. In conjunction with the infrared tracker, there has also been provided at the launch site a separate visual optical system (e.g., telescope) which is used to monitor target activity and provide a target reference point for measuring missile course correction, if required. Still further, in certain systems target thermal imaging capability has been provided in which a thermal sensor receives infrared emanations from the target which can be displayed on a cathode ray tube (CRT) or vacuum fluorescent display (VFD). This latter feature is especially useful for night operation or when smoke or fog obscures normal vision.

In the past, the launch site equipment for monitoring missile and target positions has consisted of physically separated sets of equipment, one for the infrared tracking function and the other for visual optical monitoring including thermal imaging, which has resulted in relatively complex and difficult to manage operation, particularly under field conditions. Specifically, in present day known systems, it is necessary to obtain visual optical information through an eyepiece and when it is desired to monitor an infrared image, the user of the equipment has to shift viewing positions and change focus or adjustment of the two different apparatus.

SUMMARY OF THE INVENTION

In accordance with the practice of the present invention there is provided in a portable missile launcher a single, compact, self-contained unit including both a direct view telescope for tracking the target, as well as a cathode ray tube or vacuum fluorescent display for viewing an infrared image of the target, the latter being used in target tracking at night or in the presence of smoke. Also, as a part of this unit, a missile tracking system is provided responsive to an infrared beam from a missile carried beacon for computing missile course deviations from a standard and communicating mid-course corrections to the missile, if necessary. All of the direct viewing and tracking equipment is unitarily assembled onto the portable launcher in such a manner so as not to result in adverse interaction between the various parts and to form a single light-weight package. Both the visual and infrared beam from the missile are received through the same objective lens avoiding the necessity for correctional adjustments when switching use from one to the other.

DESCRIPTION OF A PREFERRED EMBODIMENT

Figure 1:
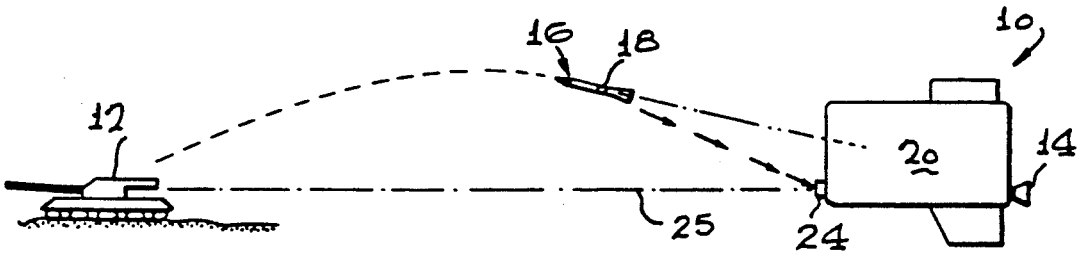
FIG. 1 is a schematic representation of a portable launcher and missile launched to intercept a target.

Turning now to the drawings, and particularly FIG. 1, there is shown in schematic representation a consolidated infrared tracker and visual/thermal image monitoring system enumerated generally as 10 which is especially adapted for use on a portable missile launcher by which a target 12 can be visually monitored by telescopic means to be described via an eyepiece 14 and, at the same time, a launched missile 16 is tracked through sensing of infrared radiation received from a beacon 18 carried by the missile and interpolating this information in an infrared tracker 20. Still further, at night or when a target is obscured by smoke, clouds, fog or the like, thermal images produced by the target are sensed by alternative optical sensing means of the system and presented on a suitable display, such as a CRT, for example.

Figure 2:
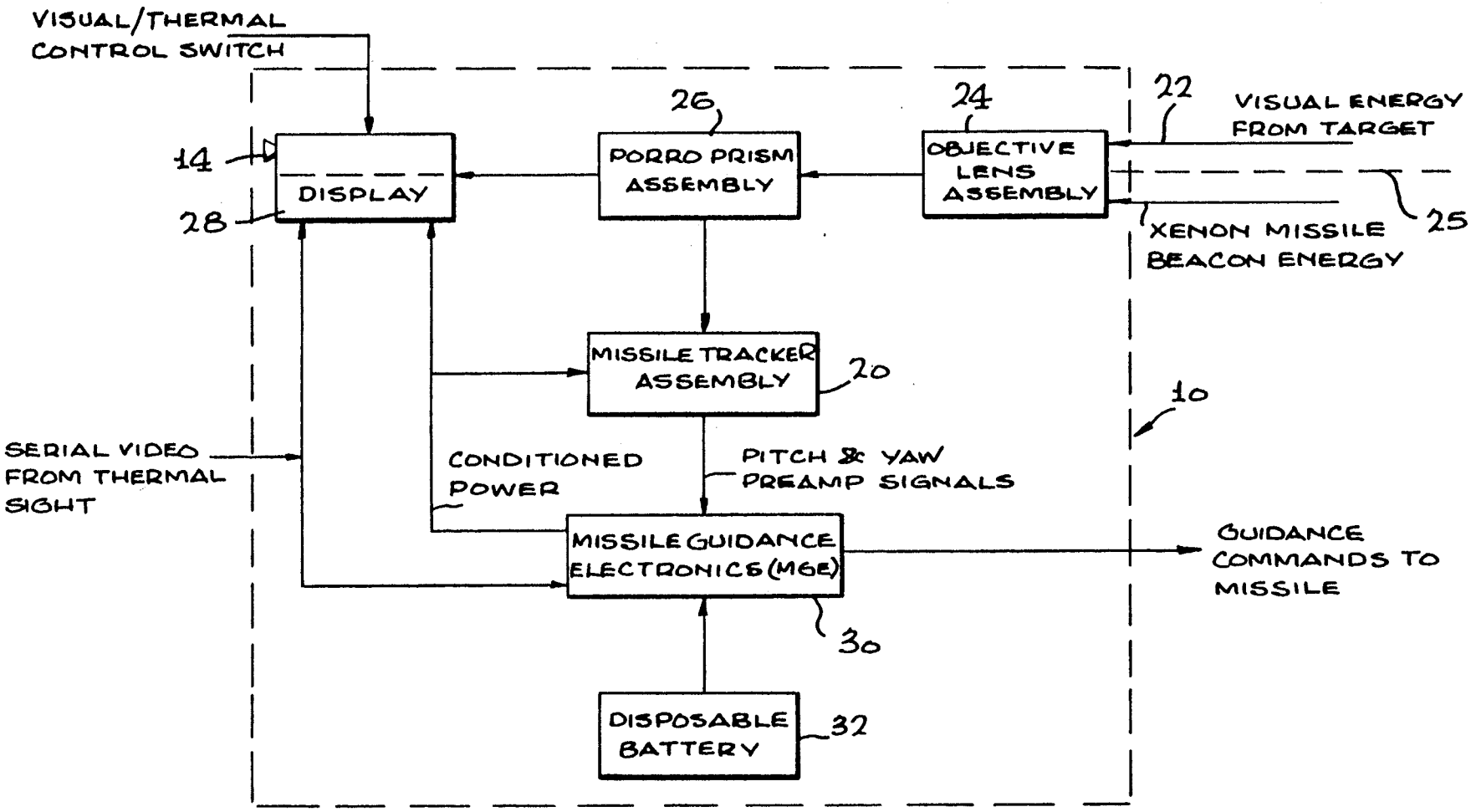
FIG. 2 is a function block schematic of the consolidated visual sight and infrared tracking system of this invention.

With reference now to FIG. 2 there is shown in function block schematic the composite parts of the visual optical and infrared tracking system 10 of this invention which are arranged in a unitary consolidated package for disposition and use on a portable missile launcher. As shown, visual light energy 22 from the target 12 is received by a single objective lens assembly 24 along with the infrared energy that is received from the missile beacon 18. More particularly, the objective lens assembly 24 is directed along a single boresight 25 for receiving both the beacon infrared and visual light energy. Such a common objective lens assembly is preferably that described in copending U.S. patent application Ser. No. 07/856,429 assigned to the same assignee as the present application.

The incoming visual and infrared energy after passing through the objective lens assembly 24 is then received by a Porro prism 26 where the radiation is separated into two different portions which are sent along separate paths. More particularly, that visible light energy coming from the target passes through the Porro prism 26 where it is directly viewed at the eyepiece 14. On the other hand, the infrared radiation from the beacon 18 is reflected by a dichroic coating (not shown) in the Porro prism along a different direction to the infrared tracker 20. A satisfactory prism should accept infrared energy in the range of 0.75 to 1.05 micrometers as well as visible energy in the range of 0.45 to 0.65 micrometers.

For simultaneous use or as an optional alternative to the visual telescopic monitoring of target activity, a long wavelength IR energy sensor 27 is mounted on the same apparatus package and can be switched on for operation separately of the visual monitoring or at the same time. The long wavelength IR received from the target forms a thermal image that can be viewed on a display 28 (e.g., CRT, vacuum fluorescent display).

Exemplary of a satisfactory beamsplitter Porro prism for use in the present invention is that described in copending U.S. patent application Ser. No. 07/823,413 assigned to the same assignee as this application.

The missile tracker 20 on receiving the infrared information from the Xenon beacon 18 aboard the missile compares this information with the visual (or thermal images) obtained and develops error signals indicative of pitch and yaw variations from those occurring when the missile is on-course. The pitch and yaw error signals are then processed by missile guidance electronics 30 producing guidance signals which are sent to the missile and utilized by equipment on board the missile for correcting the course.

It is an important aspect that the entire electric power requirements for the described system shall be provided by a disposable battery 32 rather than a rechargeable battery which has typically been used in the past.

Figure 3:
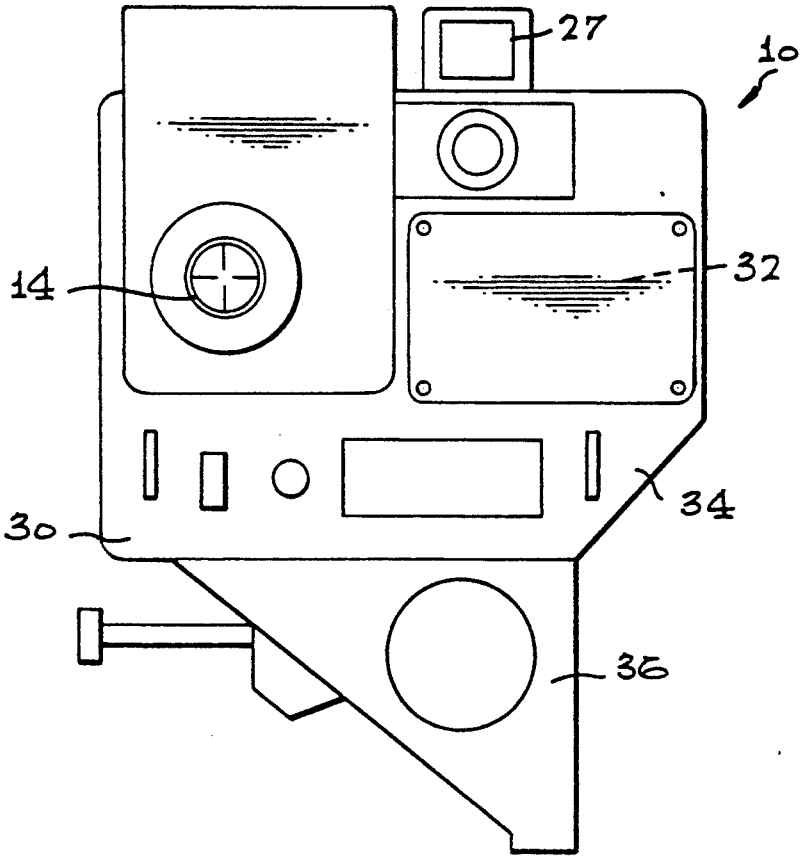
FIG. 3 is an end elevational view of the system of this invention shown mounted onto a portable launcher.

FIG. 3 shows the consolidated apparatus of the invention as viewed from operator's side. The common eyepiece 14 is located at the left just above the missile guidance electronics 30. In practical construction, the entire portable apparatus is estimated to measure 11 inches wide, 13 inches high, by 21 inches front to back, with an overall weight of 17 pounds. Moreover, all of the various component parts of the described apparatus are unitarily mounted onto a single housing 34 which includes a mounting bracket 36 for attachment to a traversing/tripod unit or other ground plane, for example, during use of the portable missile launcher.

Although the present invention is described in connection with a preferred embodiment, it is to be understood that those skilled in the appertaining arts may make changes that come within the spirit of the invention and within the ambit of the appended claims.

What is claimed is:

1. A visual target examination means and infrared missile tracker unitarily consolidated into a unitary package for use with a portable missile launcher, comprising:

a single objective lens assembly for receiving visible light energy from the target and short infrared energy from a missile beacon;

a beamsplitter prism for receiving the visible light energy and the short infrared energy from the objective lens assembly and directing the visible light energy along a first path and the short infrared energy along a second path;

an eyepiece located along the first path for observing visible images of the target;

a sensor for receiving long infrared energy from the target;

means interconnected with the sensor for displaying target images from the sensed long infrared energy;

an infrared tracker located along the second path for receiving the short infrared energy from the missile and generating missile real-time position signals;

guidance electronic circuit means responsive to the missile position signals for providing course correction signals communicated to the missile; and a single housing to which the objective lens assembly, beamsplitter prism, eyepiece, long infrared energy sensor, infrared tracker, and guidance electronic circuit means are unitarily mounted.

2. A visual target examination means and infrared missile tracker as in claim 1, in which the missile position signals correspond to yaw and pitch of the missile, which signals are compared in the guidance electronic circuit means with on-course yaw and pitch.

3. A visual target examination means and infrared missile tracker as in claim 1, in which all electric power requirements are provided by a disposable battery.

* * * * *